US005471715A

United States Patent [19]

Knize

[11] Patent Number: 5,471,715

[45] Date of Patent: Dec. 5, 1995

[54] ADJUSTABLE FASTENER ASSEMBLY FOR CANVAS COVERS AND THE LIKE

[76] Inventor: Elmer J. Knize, 3940 N. Ashland Ave., Chicago, Ill. 60613

[21] Appl. No.: 176,834

[22] Filed: Jan. 3, 1994

[51] Int. Cl.[6] ..... A41F 1/00; A43C 11/00; F16B 21/00

[52] U.S. Cl. ..... 24/596; 24/593; 24/686; 411/85; 411/553

[58] Field of Search ..... 24/68 R, 584, 24/585, 590, 591, 593, 596, 597, 683, 686; 52/3; 411/84, 85, 107, 551, 553

[56] References Cited

U.S. PATENT DOCUMENTS

| | | | |
|---|---|---|---|
| 449,940 | 4/1891 | La Dow . | |
| 526,821 | 10/1894 | Shaw . | |
| 1,385,039 | 7/1921 | Bourque . | |
| 1,956,029 | 4/1934 | Holmes | 24/596 |
| 3,405,431 | 10/1968 | Polon | 24/595 |
| 4,062,063 | 12/1977 | Bloom et al. | 24/686 X |
| 4,273,276 | 6/1981 | Perkins | 224/243 |
| 4,741,582 | 5/1988 | Peroni | 411/85 X |
| 4,934,886 | 6/1990 | Aikens | 411/85 |
| 4,961,553 | 10/1990 | Todd | 411/85 X |
| 5,050,924 | 9/1991 | Hansen | 52/3 X |

FOREIGN PATENT DOCUMENTS

| | | |
|---|---|---|
| 58463 | 4/1913 | Austria . |
| 143977 | 12/1935 | Austria . |
| 1045257 | 11/1958 | Germany . |
| 430172 | 9/1949 | Italy . |

*Primary Examiner*—Neill R. Wilson
*Attorney, Agent, or Firm*—Marshall, O'Toole, Gerstein, Murray & Borun

[57] ABSTRACT

An adjustable fastener assembly for attaching a flexible cover sheet to an object such as a boat comprises an elongated housing provided with a slot extending along its length. Within the housing, there is positioned a slide having an extension protruding through the slot in the housing. The portion protruding through the slot carries a fastening element which engages a complementary fastener such as a ring in the cover. The slide and the housing are provided with complementary locking means permitting the slide to be locked in any desired position along the length of the housing. The slide locking means is provided with a first engaging portion capable of engaging a first portion of the housing locking means which prevents movement in only a first direction along the length of the housing and a second engaging portion capable of engaging a second portion of the housing locking means which prevents movement in only a second direction along the length of the housing.

5 Claims, 2 Drawing Sheets

54A
B
54
56
48
42
44
58
50
52
A
52A
24
80
22
30
34
28
32
36
38
46
46A
46B
62
62A
60
60A
55

ADJUSTABLE FASTENER ASSEMBLY FOR CANVAS COVERS AND THE LIKE

FIELD OF THE INVENTION

This invention relates to an improved adjustable fastener assembly for attaching flexible canvas or plastic sheet coverings to objects such as small boats. In particular, the effective spacing between adjacent fasteners of the invention can be readily adjusted in order to accommodate variations in the dimensions of the cover.

BACKGROUND OF THE INVENTION

It is well known to use a canvas or plastic sheet cover or tarpaulin to cover a variety of objects against exposure to the weather. In fastening the canvas cover to the object to be protected, it has been conventional to provide the cover with spaced metal fastener elements, e.g., rings, which engage spring-loaded tabs or projections arranged at appropriate locations on the object. If the rings are properly located relative to the fastening tabs in the initial installation, a neat tight-fitting cover can be provided. With the passage of time, however, the canvas or other material of which the cover is made can stretch or shrink, thus changing the spacing between the rings and thus possibly destroying or deteriorating the smoothness of the fit of the cover over the object.

In accordance with the invention, there is provided a fastener assembly which, unlike those previously used, is not permanently fixed in one position on the object to be covered, but can instead be moved over a substantial range. Accordingly, if the cover changes its dimensions, the location of the complementary fastener assembly on the object can be changed as necessary to achieve a smooth fit.

SUMMARY OF THE INVENTION

Briefly described, the fastener assembly of the invention comprises an elongated housing provided with a slot extending along its length. Within the housing, there is positioned a slide having an extension protruding through the slot in the housing. The portion protruding through the slot carries a fastening element which engages a complementary fastener such as a ring in the cover. The slide and the housing are provided with complementary locking means permitting the slide to be locked in any desired position along the length of the housing. The slide locking means is provided with first and second engaging portions. The first engaging portion is capable of engaging a first portion of the housing locking means which only prevents movement in a first direction along the length of the housing. The second engaging portion is capable of engaging a second portion of the housing locking means which only prevents movement in a second direction along the length of the housing.

BRIEF DESCRIPTION OF THE DRAWINGS

The invention will be better understood from the detailed description which follows taken in conjunction with the accompanying drawings, in which the same numbers are used to identify corresponding elements in the different views and in which.

DETAILED DESCRIPTION OF THE INVENTION

Figure 1:
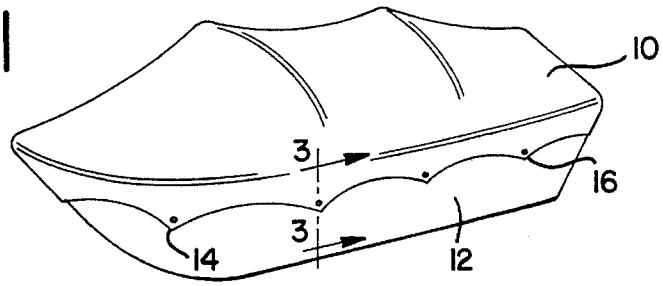
FIG. 1 is a perspective view of a small boat having a conventional canvas or plastic cover which is attached at spaced locations around its perimeter to the sides of the boat using the adjustable fastener assembly of the invention.

FIG. 1 illustrates a typical use of the fastener assembly of the invention, i.e., to hold a canvas or similar cover 10 in place on an open boat 12. The fastener assembly of the invention is used at spaced locations, e.g., 14, 16, around the perimeter of the cover to hold the cover in place.

Figure 2:
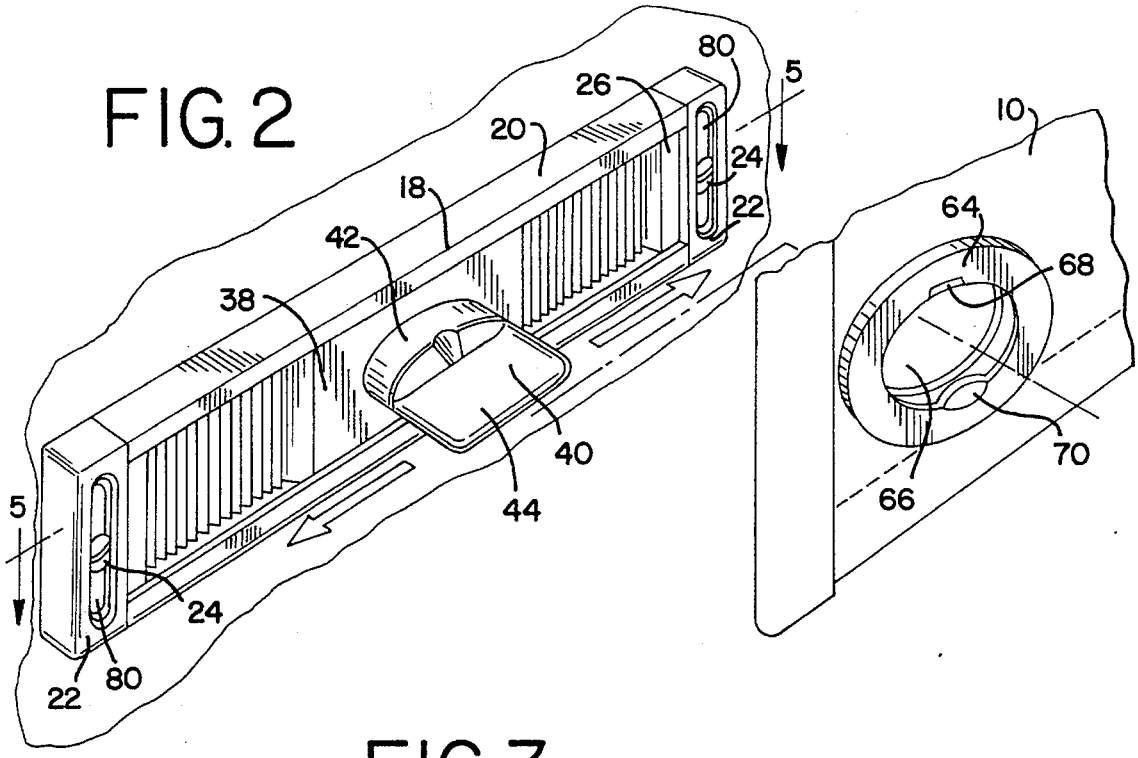
FIG. 2 is an isometric view of a fastener assembly of the invention in position on the side of the boat of FIG. 1 with a fragmentary portion of a cover containing a fastening ring in position to be installed.
Figure 3:
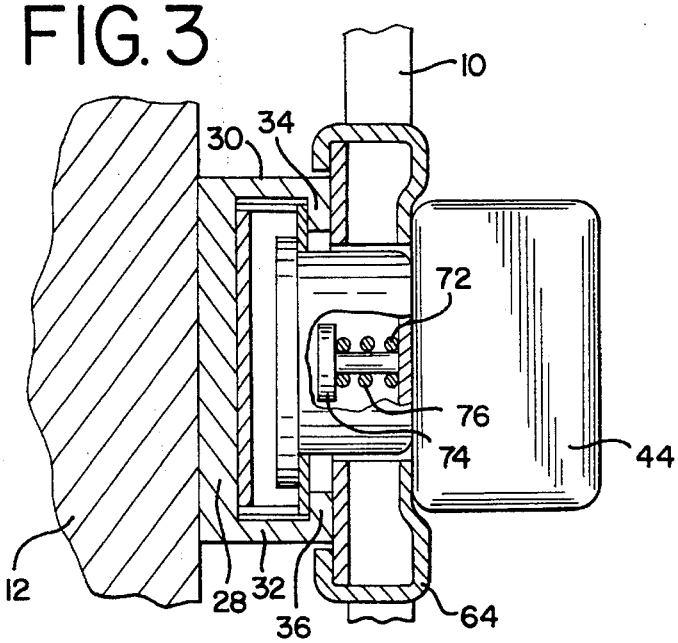
FIG. 3 is a cross sectional view along the line 3—3 of FIG. 1 showing the cover installed and locked into position in accordance with the invention.

FIG. 2 shows an isometric view of an adjustable fastener assembly 18 of the invention. Fastener 18 comprises an elongated housing 20 provided with end caps 22 which are fastened by appropriate means, e.g., screws 24 to the side of boat 12. As shown in the drawings, particularly FIGS. 3 and 4, housing 20 has a C-shaped cross section including a slot 26 which extends the length of housing 20. Housing 20 is defined by several planar members including a vertical back wall 28, horizontal top and bottom plates 30 and 32, and vertical top and bottom edge strips 34 and 36 connected respectively to the top and bottom plates. The top and bottom edge strips 34 and 36 define the edges of slot 26.

Situated within housing 16 is a movable slide 38 having a portion 40 (FIG. 2) which protrudes from slot 26. The protruding portion includes a hollow housing 42 and a rotatable locking tab 44 at its outer extremity.

The slide 38 is also provided with a positioning or locking means adapted to cooperate with a complementary positioning means on the housing 20 to lock the slide 38 at a desired location along the length of the housing 20. The housing positioning means, as best seen in FIGS. 5 and 6 are a series of generally parallel notches 46 disposed on the back wall 28 of the housing 20.

The complementary slide positioning means is a generally U-shaped leaf spring 48. The leaf spring 48 is generally a thin one-piece flexible metallic piece having a top wall 50, and first and second angled walls 52, 54 connected to opposite ends of the top wall 50. The top wall 50 is connected to the hollow housing 42 by any conventional means, such as spot welding. The end of the first angled wall 52 engages a notch 46 which prevents longitudinal movement of the slide in only one first direction relative to the housing. Likewise, the end of the second angled wall 54 engages a notch 46 which only prevents movement in a second longitudinal direction. As seen in FIG. 5, the end 52A of the first wall 52 is engaged with notch 46A which prevents the slide from moving to the left, and the end 54A of the second wall 54 is engaged with notch 46B which prevents the slide from moving to the right. Both angled walls are necessary to prevent longitudinal movement as the end of the first wall 52 will not prevent movement to the right and the end of the second wall 54 will not prevent movement to the left as each of the walls 52, 54 is flexible enough to ride over the ridges 55 between the notches 46 when moved in a direction towards the opposite angled wall.

Figures 4, 5, 6:
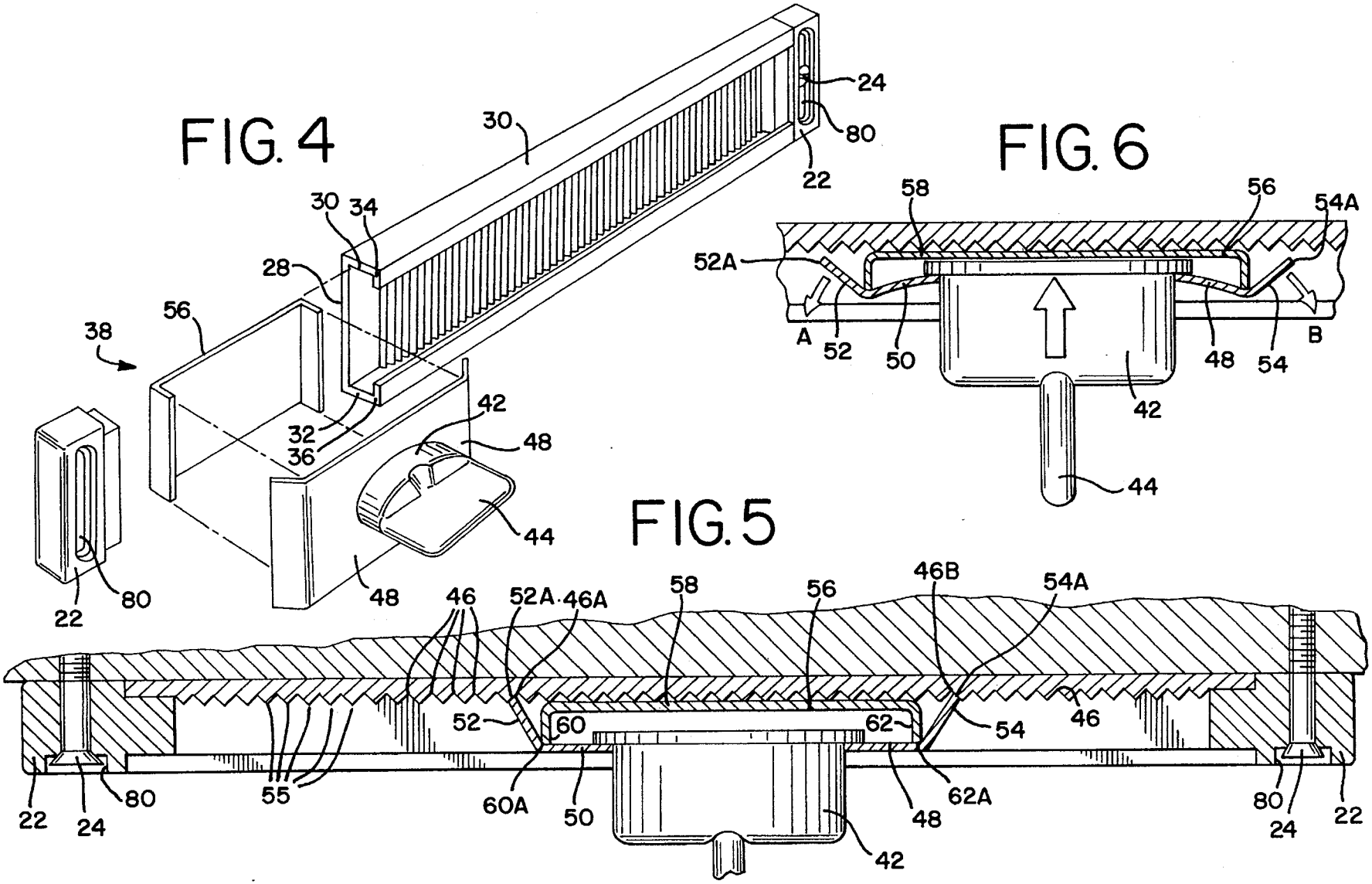
FIG. 4 is an exploded isometric view of the fastener assembly of FIG. 2, showing some of the individual elements of the assembly in greater detail.
FIG. 5 is a cross-sectional view along the line 5—5 of FIG. 2 showing the slide of the fastener of FIG. 2 in a condition where a generally U-shaped leaf spring is engaged with notches of the housing to prevent longitudinal movement along the length of the housing.
FIG. 6 is a view showing the slide of the fastener of FIG. 2 in a condition for permitting longitudinal movement along the length of the housing.

As seen in FIGS. 4–6, slide 38 preferably has a glide enhancer 56 which allows the slide 30 to easily glide longitudinally over the notched back wall 28 of the housing 20 when, as discussed below, the ends 52A, 54A of the leaf spring 48 are disengaged from the notches 46. The glide enhancer 56 is usually made of the same material as the leaf spring 48 and has a smooth bottom wall 58 and two generally parallel sidewalls 60, 62 attached to opposite ends of the bottom wall 58. Both the length of the bottom wall 58 and the distance between the ends 60A, 62A of the sidewalls 60, 62 are approximately the same as or slightly less than the length of the top wall 50 of the leaf spring 48.

The length or height of the two sidewalls 60, 62 is preferably the same and less than the length of the two angled walls 52, 54 of the leaf spring 48, the length of the angled walls being defined as the distance between the end of the angled wall 52A, 54A and intersection or connection point of the respective angled wall 52, 54 and top wall 50, and the length of the sidewalls being defined as the distance from the end of the sidewall 60A, 62A to the intersection of the respective sidewall 60, 62 and bottom wall 58. This difference in length is necessary when the sidewalls 60, 62 are generally parallel to one another. As seen in FIG. 5, the leaf spring 48 rests on the ends 60A, 62A of the sidewalls 60, 62. In order for the ends of the leaf spring to engage the notches, the angled walls 52, 54 must be longer than the sidewalls 60, 62.

FIG. 2 shows a section of cover 10 provided with a fastening ring 64 having an opening 66 which matches the contour of hollow housing 42. To complete a connection between cover 10 and boat 12, fastening ring 64 is slipped over the protruding portion 40 of slide 38, causing housing 42 to enter opening 66 in ring 64. Locking tab 44 at the outer extremity of housing 42 is then rotated 90° from the position shown in FIG. 2, causing the edge of the tab to enter opposed locking slots 68 and 70 in the surface of the fastening ring. In this condition, locking tab 44 prevents disengagement of fastening ring 64 from spring housing 42, while the action of the leaf spring 38 and the notches 46 in the back wall 28 prevents longitudinal movement of the slide within the housing.

Locking tab 44 is preferably spring loaded to permit rotation into and out of locking slots 68, 70 in fastening ring 64. Any appropriate biasing means for permitting this type of operation can be used. For example, locking tab 44 can be equipped with a rod 72 connected to a stop 74. A helical tab bias spring 76 on the rod 72 urges the locking tab in a direction towards housing 42, but still permits movement of tab 44 in the opposite direction when necessary to permit the tab to rise over an obstruction, e.g., when coming out of engagement with locking slots 68, 70 in fastening ring 64.

While the construction shown in the FIGS. employs a rotating locking tab 44 and a cooperating fastening ring 64 for attaching the cover, it should be understood that other means for attaching the cover to the slide can also be used. For example, the outer extremity of protruding portion 40 can be provided with a male snap fastener or other mechanical fastener adapted to engage a corresponding female snap fastener or other corresponding fastener installed in the cover.

In the description of the assembly shown in FIG. 5, it was assumed that slide 38 was properly positioned to permit fastening ring 64 to be attached thereto. For a number of reasons, however, e.g., stretching or shrinking of the cover, or misalignment of the fastening rings in a replacement cover, it may be necessary to readjust the location of the slide to permit engagement with the appropriate fastening rings in cover 10 in order to achieve a smooth covering. In order to reposition the slide 38 when necessary, as shown in FIG. 6, housing 42 is moved laterally relative to the length of the housing, pushing the top wall 50 of the leaf spring 48 in a lateral direction toward the bottom wall 58 of the glide enhancer 56. This lateral movement, due in part to the sidewalls 60, 62 acting as fulcrums, causes the angled walls 52, 54 and their ends 52A, 54A to respectively move in the direction of arrows A and B and disengage from the notches 46 in the back wall 28. As long as a sufficient lateral force is applied to housing 42, the ends 52A, 54A of the angled walls 52, 54 will remain disengaged from the notches 46 as the length of the sidewalls 60, 62 which contact the leaf spring 48 prevents the uplifted angled walls 52, 54 from reaching the notches 46 to allow engagement. With the ends 52A, 54A now disengaged from the notches 46, slide 38 can be moved along either direction along the length of the housing 20 to an appropriate position. When the ends 52A, 54A are disengaged and the slide is moved, the leaf spring rides on the sidewalls 60, 62 of the glide enhancer 56 and the smooth bottom wall 58 of the glide enhancer is the only portion of the slide 38 in contact with the back wall of the housing 20. During longitudinal movement, the bottom wall 58 only contacts the ridges 55 between the notches 46 and allows the slide 38 to easily glide in either direction along the length of the housing. When the slide has been moved to an appropriate position, the force pushing down the topwall 50 is released, allowing the topwall 50 of the leaf spring 48 to return to its original flat configuration and causing the angled walls 52, 54 to respectively move in a direction opposite arrows A, B reengaging the ends 52A, 54A with the notches 46 to lock the slide in the new position.

In addition to being able to be longitudinally repositioned, the slide can preferably also be repositioned in a lateral direction up and down the side of the boat 12 (a direction generally perpendicular to length of the housing 20). As best seen in FIGS. 2 and 4, the end caps 22 are provided with a slot or recess 80 which extends almost the entire length of the end cap 22. When the both fastening screws 24 are loosened from the side of the boat 12, the assembly 18 can be laterally repositioned anywhere along the length of the recess 80. After the assembly 18 has been repositioned up or down the side of the boat 12, the two screws 24 are tightened to lock the assembly in its new lateral position.

The foregoing detailed description has been given for clearness of understanding only, and no unnecessary limitations should be understood therefrom, as modifications will be obvious to those skilled in the art.

What is claimed is:

1. An adjustable fastener assembly for attaching a flexible sheet cover to an object, said fastener element comprising:

an elongated hollow housing having a slot defined by opposed edges extending the length of said housing; and a slide enclosed within said housing with a portion thereof extending through said slot, said portion carrying fastening means engageable with a cooperating fastening element on said flexible sheet cover;

said slide and said housing being provided with cooperating slide and housing positioning means which can be engaged and disengaged by lateral movement of a portion of said slide to lock said slide at a desired location along the length of said slot and to permit said slide to be moved along the length of said slot;

said slide positioning means having a first engaging portion capable of engagement with a first portion of said housing positioning means to prevent longitudinal movement of said slide in only a first direction and a second engaging portion capable of engagement with a second portion of said housing positioning means to prevent longitudinal movement of said slide in only a second direction;

said housing having a C-shaped cross section including a back wall, top and bottom plates attached to said back wall, and top and bottom edge strips attached respectively to said top and bottom plates, said edge strips defining said slot; and said slide positioning means has a generally U-shaped leaf spring having first and second ends and said housing positioning means has a corresponding notched means on said backwall, engagement of said notched means with said first and second ends preventing movement of said slide along said housing respectively in said first and second directions.

2. The assembly of claim 1 wherein said slide further comprises a glide enhancer disposed between said leaf spring and said notched means.

3. The assembly of claim 2 wherein said glide enhancer comprises a bottom wall and first and second sidewalls attached to said bottom wall and said leaf spring comprises a top wall and a first and second angled walls attached to said top wall wherein the length of said first and second angled walls is greater than the length of said first and second sidewalls.

4. The assembly of claim 3 wherein said bottom wall of said slide enhancer has a length substantially the same as said top wall and said first and second sidewalls contact said leaf spring.

5. An adjustable fastener assembly for attaching a flexible sheet cover to an object, said fastener element comprising:

an elongated hollow housing having a slot defined by opposed edges extending the length of said housing; and a slide enclosed within said housing with a portion thereof extending through said slot, said portion carrying fastening means engageable with a cooperating fastening element on said flexible sheet cover;

said slide and said housing being provided with cooperating slide and housing positioning means which can be engaged and disengaged by lateral movement of a portion of said slide to lock said slide at a desired location along the length of said slot and to permit said slide to be moved along the length of said slot;

said slide positioning means having a first engaging portion capable of engagement with a first portion of said housing positioning means to prevent longitudinal movement of said slide in only a first direction and a second engaging portion capable of engagement with a second portion of said housing positioning means to prevent longitudinal movement of said slide in only a second direction; and said fastening means has a rotatable tab and said cooperating fastening element has a ring on said cover adapted to engage said tab.

* * * * *